United States Patent [19]

Nakamura et al.

[11] Patent Number: 4,909,279

[45] Date of Patent: Mar. 20, 1990

[54] FLUID CONTROL VALVE

[75] Inventors: Ichiro Nakamura, Katsuta; Katsuharu Shuto, Shimoinayoshi; Eiichi Sasaki, Katsuta, all of Japan

[73] Assignee: Hitachi, Ltd., Tokyo, Japan

[21] Appl. No.: 377,766

[22] Filed: Jul. 10, 1989

Related U.S. Application Data

[63] Continuation of Ser. No. 155,570, Feb. 12, 1988, abandoned.

[30] Foreign Application Priority Data

Feb. 13, 1987 [JP] Japan ..... 62-29628

[51] Int. Cl.[4] ..... F15B 14/043

[52] U.S. Cl. ..... 137/881; 91/446; 91/452; 91/459; 137/596.12; 137/885; 251/63.4

[58] Field of Search ..... 91/446, 452, 459, 461; 137/596.12, 881, 885, 596.17; 251/63.4; 187/111

[56] References Cited

U.S. PATENT DOCUMENTS

| | | | |
|---|---|---|---|
| 500,645 | 7/1893 | West | 251/83 X |
| 3,477,466 | 11/1969 | Sturm | 251/63.4 X |
| 3,874,407 | 4/1975 | Griswold | 91/459 X |
| 4,148,248 | 4/1979 | Risk | 91/446 |
| 4,153,074 | 5/1979 | Risk | 137/596.12 |
| 4,457,211 | 7/1984 | Risk | 91/452 X |

FOREIGN PATENT DOCUMENTS 1382992 2/1975 United Kingdom .

OTHER PUBLICATIONS

"Hydraulic Pressure and Penumatic Pressure", from Institute of Hydraulic and Pneumatic Engineering, May 1986, vol. 17, No. 3, pp. 181–186.

*Primary Examiner*—Gerald A. Michalsky

*Attorney, Agent, or Firm*—Antonelli, Terry & Wands

[57] ABSTRACT

In a fluid control valve, a check valve is provided between the pump port and the first fluid chamber and allows the fluid to pass therethrough only in a direction from the pump port to the first fluid chamber, a down control valve is provided between the first fluid chamber and the second fluid chamber, an up control valve is provided between the first fluid chamber and the third fluid chamber, the fluid is allowed to flow from the pump port to the cylinder port through the check valve and through the down control valve when they are opened, and the fluid from the cylinder port to the tank port is allowed to flow through the down control valve, through the first fluid chamber and through the up control valve when they are opened. The fluid control valve can be obtained simple in structure and high in precision, and be allowed a reduction in cavitation and noise.

8 Claims, 3 Drawing Sheets

FLUID CONTROL VALVE

This application is a continuation of application Ser. No. 07/155,570, filed Feb. 12, 1988, now abandoned.

BACKGROUND OF THE INVENTION

1. Field of the Invention

The present invention relates to a fluid control valve for controlling a fluid flow of large flow rate, such as that used in a fluid pressure elevator to supply a high pressure fluid to, and discharge it from, a fluid pressure jack to raise or lower the cage of the elevator.

2. Prior Art

As described in the Publication "Hydraulic pressure and pneumatic pressure" from Institute of Hydraulic and Pneumatic Engineering, May 1986, Vol. 17, No. 3, pages 181–186, conventional flow control valves of this type have ports respectively communicating with a pump fluid pressure cylinder and with a tank, and also have hermetic fluid control parts each between a pump port and a fluid pressure cylinder port and between the fluid pressure cylinder port and a tank port. These fluid control parts use a pilot valve to control the fluid.

The above-mentioned type fluid control valves are complicated in structure, because they are intended to achieve a high precision flow rate control, which is the inherent object of the fluid control valves, while ensuring a hermetic seal to keep the fluid pressure cylinder at rest. Further, in controlling the fluid, they will cause cavitation, producing large noises, because they will execute the flow-rate control of the high pressure fluid.

SUMMARY OF THE INVENTION

An object of the present invention is to provide a fluid control valve which is simple in structure and high in precision, and which allows a reduction in cavitation and noise.

The above object is achieved by a fluid control valve, wherein a check valve is provided between the pump port and the first fluid chamber and allows the fluid to pass therethrough only in a direction from the pump port to the first fluid chamber, a down control valve is provided between the first fluid chamber and the second fluid chamber, an up control valve is provided between the first fluid chamber and the third fluid chamber, the fluid is allowed to flow from the pump port to the cylinder port through the check valve and through the down control valve when they are opened, and the fluid from the cylinder port to the tank port is allowed to flow through the down control valve, through the first fluid chamber and through the up control valve when they are opened.

When the fluid pressure jack is to be lowered, the fluid is controlled such that it is first made to flow into the first fluid chamber via the down control valve, and is subsequently discharged to the tank port via the up control valve.

Because the fluid to be discharged is controlled in two steps as described above, the present invention can reduce cavitation and noise.

According to the present invention, during lowering of the fluid pressure jack, the fluid is controlled to be flowed into the first fluid chamber via the down control valve and to be flowed out to the tank port via the up control valve. Thereby, the pressure drop can be made smooth, further the occurrence of cavitation can be suppressed and the noise and the pulsation can be reduced.

Furthermore, according to the present invention, since the seal for hermetically enclosing the fluid in the fluid pressure jack is provided only in a single location, i.e. the down control valve, it is possible to increase the reliability and surely maintain the sealing. Further, since the pilot switching valves are PWM-controlled to control the operation of the down and up control valves, it is possible to freely enlarge the range of control.

DESCRIPTION OF THE EMBODIMENT

Figure 1:
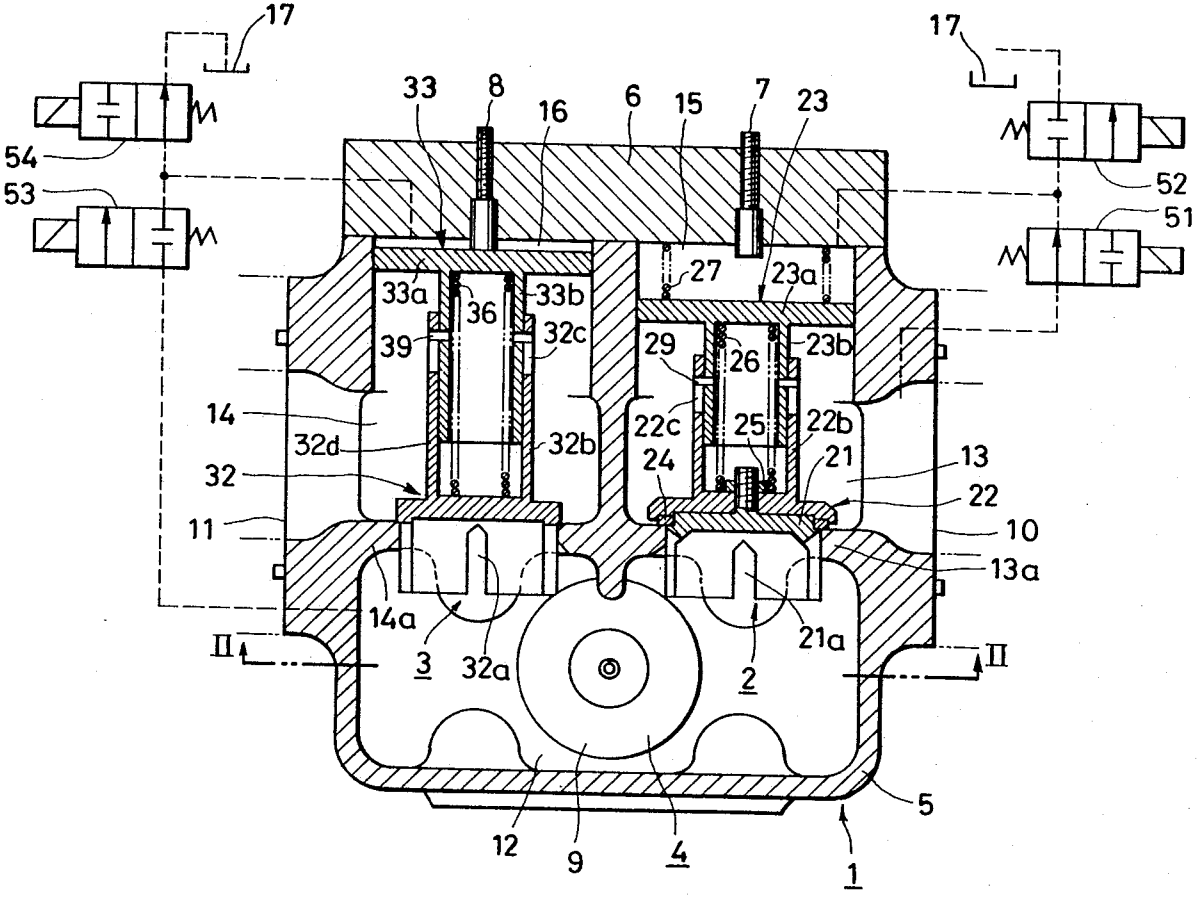
FIG. 1 is a cross-sectional view of a fluid control valve showing one embodiment of the present invention.

One embodiment of the present invention will be explained with reference to FIG. 1.

A flow control valve 1 has a valve housing 5. The valve housing 5 is formed with a first fluid chamber 12 at the lower portion thereof, which communicates with a pump port 9. The valve housing 5 is formed further with a second fluid chamber 13 at one side of the upper portion thereof, which communicates with a cylinder port 10, and a third fluid chamber 14 at the other upper side, which communicates with a tank port 11. The valve housing 5 is closed at the top with a valve cover 6. A check valve 4 is provided in the opening of the first fluid chamber 12 and the pump port 9.

A down control valve 2 is provided in the second fluid control chamber 13. An up control valve 3 is provided in the third fluid chamber 14. The down control valve 2 is constituted by a pressure receiving member 23 having a pressure receiving terminal plate **23*a* with an inner tube 23*b* projecting from the lower side thereof, a disk-shaped valve body 22 with an outer tube 22*b* which projects therefrom and which is slidable on the inner tube 23*b*, and a valve poppet 21** which is a bottomed tubular body.

The valve poppet 21 is connected to the valve body 22 by means of a bolt and nut 25, an annular seal member 24 being secured between the valve poppet 21 and the valve body 22. A plurality of cut grooves **21*a* are also axially provided in the skirt portion of the valve poppet 21. The valve poppet 21 has its skirt portion slidingly inserted into a circular hole in a partition wall 13*a* which separates the first fluid chamber 12 from the second fluid chamber 13**.

The pressure receiving terminal plate **23*a* of the pressure receiving member 23 is slidable in an upper cylindrical part of the second fluid chamber 13, thereby the pressure receiving terminal plate 23*a* separates the second fluid chamber 13 from a back pressure chamber 15 disposed above the pressure receiving terminal plate 23*a*. The outer tube 22*b* of the valve body 22 has a plurality of axial slots 22*c* cut therein. The axial slots 22*c* engage with pins 29 projecting from the inner tube 23*b*. The pins 29 are slidable along the axial slots 22*c* limiting the extent of the relative sliding movement between the valve body 22 and the pressure receiving member 23**.

A compression spring 26 is provided in the inner tube 23b and between the pressure receiving terminal plate 23a and the valve body 22. Another compression spring 27 is provided in the back pressure chamber 15 disposed above the pressure receiving terminal plate 23a. A stopper 7 limits the extent of displacement of the down control valve 2. The compression springs 26 and 27 normally bias to separate the second fluid chamber 13, which communicates with the cylinder port 10, from the first fluid chamber 12, which communicates with the pump port 9. Sealing is then provided by a sealing member 24 and a valve seat formed on the edge portion of the circular hole of the partition wall 13a.

According to the down control valve 2 having a structure as described above, for example, when the fluid is supplied from the pump port 9 to the cylinder port 10, the pressure receiving terminal plate 23a of the pressure receiving member 23 is slidable in the upper cylindrical part of the second fluid chamber 13. Thereby, the valve body 22 can operate for the control signal regardless of the pressure in the back pressure chamber 15 and therefore a high responsibility can be obtained.

Referring again to FIG. 1, there are shown pilot valves 51, 52, 53 and 54, which are high speed ON-OFF switching valves, or so called PWM-controlled valves whose operation is controlled by controlling the pulse duration of a pulse train.

The pump port 9 is connected to a fluid pressure pump, the cylinder port 10 to the fluid pressure jack for raising and lowering a load, and the tank port 11 to a tank.

The pilot valve 51 is provided in a passage extending between the second fluid chamber 13 and the back pressure chamber 15 disposed above the pressure receiving terminal plate 23a. The pilot valve 52 is provided in a passage extending between the back pressure chamber 15 and the tank 17. The pilot valve 53 is provided in a passage between the first fluid chamber 12 and the back pressure chamber 16 disposed above the pressure receiving terminal plate 33. The pilot valve 54 is provided in a passage extending between said back pressure chamber 16 and the tank 17.

The up control valve 3 is constituted by a pressure receiving member 33 having a pressure receiving terminal plate 33a with a downwardly projecting inner tube 33b, and a valve body 32 in the form of a bottomed tubular body 32d having a projecting outer tube 32b which is slidable over the inner tube 33b.

The bottomed tubular body of the valve body 32 has a skirt portion formed with a plurality of axial cut grooves 32a. The skirt portion of the bottomed tubular body is slidingly inserted into a circular hole in a partition wall 14a which separates the first fluid chamber 12 from the third fluid chamber 14. The first fluid chamber 12 and the third fluid chamber 14 communicate with each other through the cut grooves 32a when the valve body 32 is moved upward, and the two fluid chambers 12 and 14 are separated when the valve body 32 is moved downward.

Further, as in the case of the down control valve 2, the pressure receiving terminal plate 33a of the pressure receiving member 33 is slidable in the upper cylindrical portion of the third fluid chamber 14. The pressure receiving terminal plate 33a separates the third fluid chamber 14 from a back pressure chamber 16 disposed above the pressure receiving terminal plate 33a.

The outer tube 32b of the valve body 32 has a plurality of axial slots 32c. The axial slots 32c engage with pins 39 projecting from the inner tube 33b. The pins 39 are movable within the axial slots 32c limiting the extent of the relative sliding movement between the valve body 32 and the pressure receiving member 33. A compression spring 36 is provided in the inner tube 33b and between the pressure receiving terminal plate 33a and the valve body 32. A stopper 8 limits the upward movement of the pressure receiving terminal plate 33a.

Figure 2:
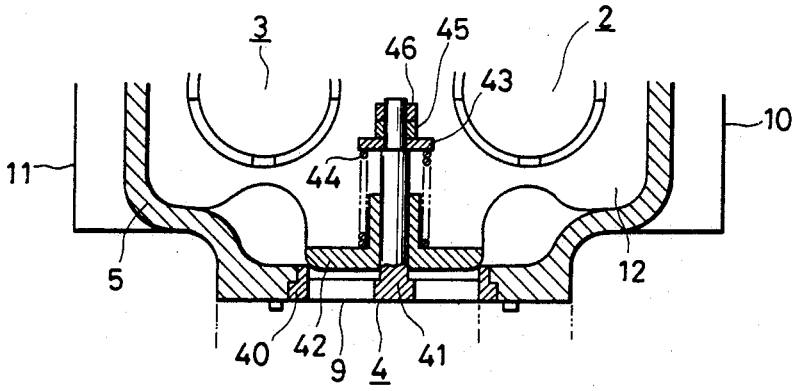
FIG. 2 is a cross-sectional view taken along the line II—II of FIG. 1, as seen in the arrow direction.

As shown in detail in FIG. 2, the check valve 4 is arranged between the pump port 9 and the first fluid chamber 12. The check valve 4 comprises a valve seat 40 located on the edge portion of the pump port 9, a valve guide bar 41 formed integral with the valve seat 40 and standing in the middle, and a valve poppet 42 having such an outer diameter as to allow the poppet to seat against the valve seat 40. The valve poppet 42 has a center hole passed through by the valve guide bar 41 and is capable of sliding up and down along the valve guide bar 41.

A compression spring 44 is provided between the rear surface of the valve poppet 42 and a spring seat 43 secured to the upper end of the valve guide bar 41 and fixed thereto by nuts 45 and 46. The compression spring 44 exerts a thrust in such a direction as to cause the valve poppet 42 to join the valve seat 40. The valve poppet 42 is raised to allow the flow from the pump port 9 into the first fluid chamber 12 when the pressure in the pump port 9 is greater than the sum of the pressure in the first fluid chamber 12 and the thrust of the compression spring 44.

But the valve poppet 42 is instead made to join the valve seat 40, thereby blocking the flow from the first fluid chamber 12 to the port 9, when the sum of the pressure in the first fluid chamber 12 and the thrust of the compression spring 44 exceeds the pressure in the pump port 9.

Figure 3:
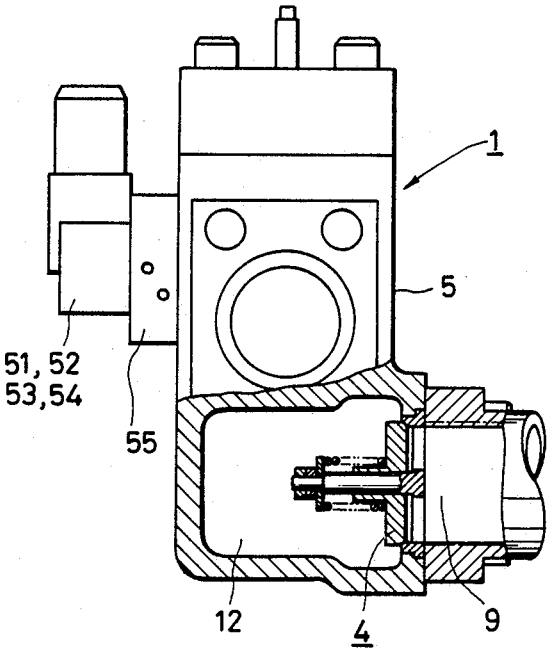
FIG. 3 is a partically cutaway side elevation view of the fluid control valve.

FIG. 3 is a partially cutaway side elevation view of the flow control valve 1. The pump port 9, the check valve 4 and the first fluid chamber 12 are arranged respectively below the valve housing 5. The pilot valves 51, 52, 53 and 54 are fixed to the valve housing 5 by means of a subplate 55. The connecting passages of the pilot valves 51, 52, 53 and 54 are formed in the subplate 55.

The flow control valve 1, having a structure as described above, operates as follows:

In order to raise the fluid pressure jack, the fluid pressure pump is actuated and the fluid discharged thereby overcomes the thrust of the compression spring 44, thereby to force the valve poppet 42 of the check valve 4 to open, and flows into the first fluid chamber 12. Such fluid will overcome the thrust of the compression spring 36, thereby to force the valve body 32 of the up control valve 3 to open, and will return to the tank 17 through the cut grooves 32a provided in the skirt portion of the valve body 32 via the third fluid chamber 14 and the tank port 11. The flow resistance then is adjusted by means of the stopper 8.

When the pilot valve 54 is closed and a pulse signal is applied to the pilot valve 53 in a manner as described above, the latter will be switched in proportion to the pulse modulation ratio, whereby the fluid in the first fluid chamber 12 is admitted into the back pressure chamber 16 and as a result the valve body 32 is lowered together with the pressure receiving member 33 by the difference between the forces exerted from the two fluid chambers 12 and 16. The open area provided by the cut grooves 32*a* is thus reduced and the flow resistance becomes larger accordingly, so that the fluid pressure in the first fluid chamber 12 becomes higher.

When such pressure is slightly higher than the pressure in the cylinder port 10, the thrust of the compression spring 27 is overcome and the valve poppet 21, the valve body 22 and the pressure receiving member 23 of the down control valve 2 are forced to open as a single body. Whereby the pressurized fluid is supplied to the fluid pressure jack through the cut grooves 21*a*, provided in the skirt portion of the valve poppet 21, and via the second fluid chamber 13 and the cylinder port 10. When the up control valve 3 is fully closed, all of the fluid discharged from the pump is supplied to the fluid pressure jack.

To decelerate the fluid pressure jack, the pilot valve 53 is closed and a pulse train signal is applied to the pilot valve 54, whereby the pilot valve 54 is opened. As a result the fluid is discharged from the back pressure chamber 16 into the tank 17 at a flow rate which is proportional to the pulse duration modulation ratio. The valve body 32 and the pressure receiving member 33, then forming in combination a single body, are thus raised by the pressure in the first fluid chamber 12.

The open area of the cut grooves 32*a* becomes larger and the fluid flow rate discharged to the tank port 11 becomes higher accordingly, so that the flow rate supplied from the cylinder port 10 to the fluid pressure jack will decrease notwithstanding the pressurized fluid flowing into the first chamber 12 from the pump port 9.

When the pressure in the first fluid chamber 12 decreases to about the pressure in the cylinder port 10, the valve body 22 of the down control valve 2 is lowered by the thrust of the compression spring 26, blocking the communication between the first and the second fluid chambers 12 and 13, and sealing is ensured between the sealing member 24 and the valve seat. The fluid pressure jack, therefore, can securely maintain its present position.

It will be understood that the acceleration speed and the deceleration speed of the fluid pressure jack can then be freely controlled by means of the pulse duration modulation ratio for the pulse train which drives the pilot valves 53 and 54.

Next, the lowering of the fluid pressure jack will be described.

When the pilot valve 51 is closed and a pulse train signal is applied to the pilot valve 52, the pilot valve 52 is opened and the fluid is discharged from the back pressure chamber 15 to the tank 17 at a flow rate which is proportional to the pulse duration modulation ratio. The fluid pressure exerted from the second fluid chamber 13 on the pressure receiving member 23 forces the valve body 22 to rise together with the pressure receiving member 23, thereby increasing the open area of the cut grooves 21*a* in the skirt portion of the valve poppet 21. The pressurized fluid, which was acting on the fluid pressure jack, will flow from the cylinder port 10 into the first fluid chamber 12 via the second fluid chamber 13 and hence the fluid pressure jack will be lowered.

The fluid which has flown into the first fluid chamber 12 is prevented from flowing out to the pump port 9 by blocking the check valve 4, so that it will raise the valve body 32 of the up control valve 3 by overcoming the thrust of the compression spring 36, thereby flowing out to the tank 17 via the third fluid chamber 14 and the tank port 11.

On the other hand, to decrease the flow rate, the pilot valve 52 is closed and the pilot valve 51 is driven by a pulse train signal, so that such valve pilot 51 is opened. Accordingly a flow rate proportional to the pulse duration modulation ratio is supplied to the back pressure chamber 15, thereby lowering the valve body 22 and the pressure receiving member 23.

The open area of the cut grooves 21*a* provided in the skirt portion of the valve poppet 21 is thus decreased and the flow rate from the cylinder port 10 to the tank port 11 is decreased accordingly. In this case, the fluid flows from the cylinder port 10 to the tank port 11 through both the down control valve 2 and the up control valve 3. That is, the lowering of the pressure occurs in two steps. This can suppress or reduce cavitation.

Just as in the case of the up control valve 3, the acceleration speed and the deceleration speed of the fluid pressure jack can be arbitrarily controlled by varying the pulse duration modulation ratio of the pulse signal which excites the pilot valves 51 and 52.

The sealing of the check valve 4 is necessitated only during the lowering operation, and a degree of necessitated sealing is such that a slight leakage is permitted so long as the pump will not run reversely and be damaged. That is, a low accuracy of machining of the check valve 4 will cause no problems.

Figure 4:
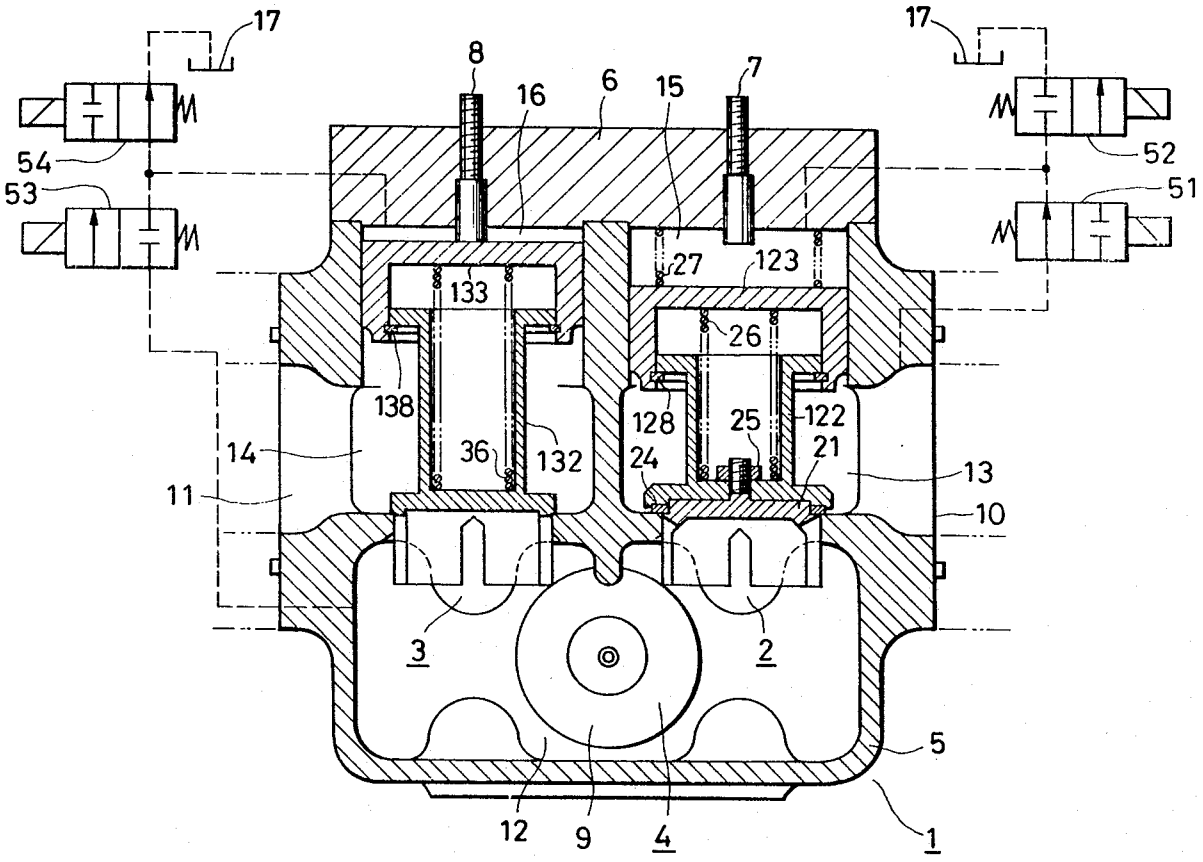
FIG. 4 is a cross-sectional view of a fluid control valve showing another embodiment of the present invention.

Referring to FIG. 4, there is shown a flow control valve according to another embodiment of the present invention, in which the same parts as those of the above-described embodiment are denoted by the same references and therefore their description will be omitted. This embodiment differs from the above-described embodiment in the connecting structure of valve bodies 122 and 132 and pressure receiving members 123 and 133. In this embodiment, the pressure receiving members 123 and 133 are cup-shaped and the valve bodies 122 and 132 are inserted therein, their separation being prevented by snap rings 128 and 138.

This flow control valve operates in the same manner and has the same benefits as the above-described embodiment.

We claim:

1. A fluid control valve comprising a first fluid chamber connected to a pump port, a second fluid chamber connected to a cylinder port, and a third fluid chamber connected to a tank port, said fluid control valve being arranged to control flow from said pump port to said cylinder port, or from said cylinder port to said tank port, and further comprising a check valve provided between said pump port and said first fluid chamber for allowing the fluid to pass therethrough only in a direction from said pump port to said first fluid chamber, a down control valve provided between said first fluid chamber and said second fluid chamber, an up control valve provided between said first fluid chamber and said third fluid chamber, a first pulse width modulated pilot valve connected to said down control valve, a second pulse width modulated pilot valve connected to said up control valve whereby the fluid is allowed to flow from said pump port to said cylinder port through said check valve and through said down control valve when said check valve and said down control valve are opened, and the fluid from said cylinder port to said tank port is allowed to flow through said down control valve, through said first fluid chamber and through said up control valve when said down control valve and said up control valve are opened, and wherein said down control valve is controlled in accordance with a first pulse width modulated signal for driving said first pilot valve, said first signal having a pulse duration modulation ratio of an optional size, and said up control valve is controlled in accordance with a second pulse width modulated signal for driving said second pilot valve, said second signal having a pulse duration modulation ratio of an optional size.

2. A flow control valve according to claim 1, wherein said down control valve includes a valve body which, when acted upon by a pressure in said first fluid chamber, is movable in an opening direction, a compression spring which is preloaded in a reverse direction with respect to such pressure receiving direction, and a pressure receiving member provided on the other side of said valve body and receiving a back pressure.

3. A flow control valve according to claim 2, wherein said valve body is provided with an annular sealing member which is located opposite to a valve seat.

4. A flow control valve according to claim 1, wherein said up control valve includes a valve body which, when exerted upon by a pressure in said first fluid chamber, is movable in an opening direction, a compression spring preloaded in the reverse direction with respect to such pressure receiving direction, and a pressure receiving member provided on the other side of said valve body and receiving a back pressure.

5. A fluid control valve comprising a first fluid chamber connected to a pump port, a second fluid chamber connected to a cylinder port, and a third fluid chamber connected to a tank port, said fluid control valve being arranged to control flow from said pump port to said cylinder port, or from said cylinder port to said tank port, a check valve provided between said pump port and said first fluid chamber for allowing the fluid to pass therethrough only in a direction from said pump port to said first fluid chamber, a down control valve provided between said first fluid chamber and said second fluid chamber, an up control valve provided between said first fluid chamber and said third fluid chamber, a first pulse width modulated pilot valve connected to said down control valve, a second pulse width modulated pilot valve connected to said up control valve, whereby the fluid is allowed to flow from said pump port to said cylinder port through said check valve and through said down control valve when said check valve and said down control valve are opened, and the fluid from said cylinder port to said tank port is allowed to flow through said down control valve, through said first fluid chamber and through said up control valve when said down control valve and said up control valve are opened, wherein said down control valve is controlled in accordance with a first pulse width modulated signal for driving said first pilot valve, said first signal having a pulse duration modulation ratio of an optional size and said up control valve is controlled in accordance with a second pulse width modulated signal for driving said second pilot valve, said second signal having a pulse duration modulation ratio of an optional size, and wherein said down control valve includes a pressure receiving member for receiving a back pressure from an upper portion and having an inner cylindrical tube being projected to a lower portion, and a valve body which, when acted upon by a pressure in said first fluid chamber, is movable in an opening direction, and having an outer cylindrical tube being formed to slide to said inner cylindrical tube.

6. A fluid control valve according to claim 5, wherein said up control valve includes a pressure receiving member for receiving a back pressure from an upper portion and having an inner cylindrical tube being projected to a lower portion, a valve body which, when acted upon by a pressure in said first fluid chamber, is movable in an opening direction, and having an outer cylindrical tube being formed to slide to said inner cylindrical tube, and a spring member provided in said inner cylindrical tube between said pressure receiving member and said valve body.

7. A fluid control valve comprising a first fluid chamber connected to a pump port, a second fluid chamber connected to a cylinder port, and a third fluid chamber connected to a tank port, said fluid control valve being arranged to control flow from said pump port to said cylinder port, or from said cylinder port to said tank port, a check valve provided between said pump port and said first fluid chamber for allowing the fluid to pass therethrough only in a direction from said pump port to said first fluid chamber, a down control valve provided between said first fluid chamber and said second fluid chamber, an up control valve provided between said first fluid chamber and said third fluid chamber, a first pilot valve connected to said down control valve, a second pilot valve connected to said up control valve, whereby the fluid is allowed to flow from said pump port to said cylinder port through said check valve and through said down control valve when said check valve and said down control valve are opened, and the fluid from said cylinder port to said tank port is allowed to flow through said down control valve, through said first fluid chamber and through said up control valve when said down control valve and said up control valve are opened, wherein said down control valve is controlled in accordance with a first signal for driving said first pilot valve and said up control valve is controlled in accordance with a second signal for driving said second pilot valve, and wherein said down control valve includes a pressure receiving member for receiving a back pressure from an upper portion and having an inner cylindrical tube being projected to a lower portion, and a valve body which, when acted upon by a pressure in said first fluid chamber, is movable in an opening direction, and having an outer cylindrical tube being formed to slide to said inner cylindrical tube wherein a plurality of axial slots are provided on said outer cylindrical tube, and pins for engaging with said axial slots are provided on said inner cylindrical tube for limiting the relative sliding movement between said inner and outer cylindrical tubes.

8. A fluid control valve having a first fluid chamber connected to a pump port, a second fluid chamber connected to a cylinder port, and a third fluid chamber connected to a tank port, said fluid control valve being arranged to control flow from said pump port to said cylinder port, or from said cylinder port to said tank port and comprising a check valve provided between said pump port and said first fluid chamber for allowing the fluid to pass therethrough only in a direction from said pump port to said first fluid chamber, a down control valve provided between said first fluid chamber and said second fluid chamber, an up control valve provided between said first fluid chamber and said third fluid chamber, a first pulse width modulated pilot valve connected to said down control valve, a second pulse width modulated pilot valve connected to said up control valve whereby the fluid is allowed to flow from said pump port to said cylinder port through said check valve and said down control valve are opened, and the fluid from said cylinder port to said tank port is allowed to flow through said down control valve, through said first fluid chamber and through said up control valve when said down control valve and said up control valve are opened, wherein said down control valve is controlled in accordance with a first pulse width modulated signal for driving said first pilot valve, said first signal having a pulse duration modulation ratio of an optional size, and said up control valve is controlled in accordance with a second pulse width modulated signal for driving said second pilot valve, said second signal having a pulse duration modulation ratio of an optional size, said down control valve includes a valve body which, when acted upon by a pressure in said first fluid chamber, is movable in an opening direction, a compression spring which is preloaded in a reverse direction with respect to such pressure receiving direction, and a pressure receiving member provided on the other side of said valve body and receiving a back pressure, said up control valve includes a valve body which, when exerted upon by a pressure in said first fluid chamber, is movable in an opening direction, a compression spring preloaded in the reverse direction with respect to such pressure receiving direction, and a pressure receiving member provided on the other side of said valve body and receiving a back pressure, a first back pressure chamber provided between said first pilot valve and said tank port, and a second back pressure chamber provided between said second pilot valve and another tank port, thereby a flow amount for supplying fluid to or discharging fluid from said first back pressure chamber is controlled in accordance with a pulse duration modulation ratio of said first signal for driving said first pilot valve, and a flow amount for supplying fluid to or discharging fluid from said second back pressure chamber is controlled in accordance with a pulse duration modulation ratio of said second signal for driving said second pilot valve.

* * * * *